US005314240A

United States Patent [19]

Ishi et al.

[11] Patent Number: 5,314,240

[45] Date of Patent: May 24, 1994

[54] SHELL STRUCTURE FOR USE WITH A CHAIR HAVING SYNCHRONOUSLY MOVING SEAT AND SEAT BACK

[75] Inventors: Yuji Ishi; Toru Nagao, both of Osaka; Harumatsu Sato, Tokyo, all of Japan

[73] Assignee: Itoki Co., Ltd., Tokyo, Japan

[21] Appl. No.: 813,788

[22] Filed: Dec. 27, 1991

[30] Foreign Application Priority Data

May 21, 1991 [JP] Japan ..... 3-144074
Oct. 11, 1991 [JP] Japan ..... 3-290393

[51] Int. Cl.[5] ..... A47C 7/02

[52] U.S. Cl. ..... 297/452.15; 297/452.21; 297/452.29; 297/DIG. 2

[58] Field of Search ..... 297/DIG. 1, DIG. 2, 297/452, 454, 444, 457, 458, 459, 460, 455, 456

[56] References Cited

U.S. PATENT DOCUMENTS

| | | | |
|---|---|---|---|
| 3,669,496 | 6/1972 | Chisholm | 297/457 X |
| 3,734,561 | 5/1973 | Barecki et al. | 297/457 X |
| 4,123,105 | 10/1978 | Frey et al. | 297/456 X |
| 4,368,917 | 1/1983 | Urai | 297/458 X |
| 4,418,958 | 12/1983 | Watkin | 297/458 X |
| 4,498,702 | 2/1985 | Raftery | 297/458 X |
| 4,556,254 | 12/1985 | Roberts | 297/460 |
| 4,660,887 | 4/1987 | Fleming et al. | 297/458 X |
| 4,776,633 | 10/1988 | Knoblock et al. | 297/457 X |
| 4,856,846 | 8/1989 | Lohmeyer | 297/457 X |
| 4,892,356 | 1/1990 | Pittman et al. | 297/460 X |

FOREIGN PATENT DOCUMENTS 2723722 4/1977 Fed. Rep. of Germany ..... 297/460

*Primary Examiner*—Kenneth J. Dorner
*Assistant Examiner*—Milton Nelson, Jr.
*Attorney, Agent, or Firm*—Rogers & Killeen

[57] ABSTRACT

A shell for a chair in which a bottom shell structure and a backrest shell structure are connected to supporting frame members such that when a light load is applied to the separate backrest shell the backrest shell will bend to accommodate the load, whereas when a heavy load is applied to the backrest shell the backrest bends and the supporting bars rock backwards. The bottom shell structure has a bottom portion and a partial backrest portion which are integrally formed on the same material and are connected by a curved portion with plural slots. Sideways notches are connected to the extreme left and right slots and extend toward the left and right edges of the shell structure. The edges of the shell adjacent the notches are curved into a U shape. This construction increases the flexibility of the curved portion, while maintaining a significant portion of the unslotted material strength. A separate shell structure is attached to supporting bars and forms the remainder of the backrest support. This separate shell structure has a jagged cross sectional shape where substantially parallel projections and recesses form grooves which extend the length of the backrest shell.

8 Claims, 13 Drawing Sheets

SHELL STRUCTURE FOR USE WITH A CHAIR HAVING SYNCHRONOUSLY MOVING SEAT AND SEAT BACK

BACKGROUND OF THE INVENTION

1. Field of the Invention

The present invention relates to a shell structure and, more particularly, to an inner shell preferably used for integrally forming the seat with the seat back of a chair having a frame construction in which the seat and seat back move synchronously.

2. Description of the Related Art

There have hitherto been proposed various types of office swivel chairs in which the seats and seat backs thereof move synchronously. More specifically, members for attaching and supporting the seats and seat backs are rocked, whereby the seats are moved up and down, and the seat backs are moved back and forth.

There are two types of rocking mechanisms: a rocking mechanism in which the seat portion and the backrest of a chair are rocked on the same component because only one member is used for attaching the seat portion and the backrest; a rocking mechanism in which the seat portion and the backrest of a chair are rocked on two or more different components because the seat portion is connected through a link member to the backrest. In both cases, from the viewpoint of human engineering or the functions of the seat and backrest, the seat portion and the backrest are designed so as not to have the same range in which they are rocked.

A range in which the seat portion moves differs from that in which the backrest moves. When these two components are supported by an inner shell, in which both components are integrally formed, or by such an inner shell and an outer shell, the inner or outer shell must have elasticity and a construction so that either shell can move as various components of a chair move in a manner different from that of either shell, even though the seat portion and the backrest are made of the same material.

On the other hand, many chairs, each having a shell structure which permits a backrest thereof to incline, do not incline smoothly. This is because the repelling force of a repelling member, such as a spring, is too strong, or because friction occurs between an inclining shaft of an inclining mechanism and a bearing thereof.

The use of, for example, a spring having a weak repelling force enables the backrest of the shell structure to incline rather smoothly. However, even when only a little load is applied to the backrest, as when a seated person changes the position of his back, instead of a heavy load being applied to the backrest, as when the person leans against the backrest, the backrest inclines unstably and too readily.

SUMMARY OF THE INVENTION

In view of the above construction, several shell structures have hitherto been proposed. A first object of the present invention is to provide a shell structure capable of smoothly and reliably moving in a manner different from the manner in which a seat portion and a backrest move.

In view of the fact that if a backrest having a shell structure inclines too stiffly or smoothly, a chair having such a shell structure is not comfortable, a second object of this invention is to provide an inner shell type shell structure for a backrest, in which shell structure a light load applied to the backrest is supported by deflection or bending of a backrest member, whereas a heavy load applied to the backrest when a person leans entirely against the backrest is supported by rocking of back supporting bars. The shell structure for the backrest can thus be operated in accordance ,with the load being applied to the backrest.

To achieve the first object, this invention provides a shell structure for use with a chair having a synchronously moving seat and seat back, in which a shell structure bottom portion of which the seat is formed and a backrest portion of which the seat back is formed are integrally formed of the same continuous material through a curved connecting portion, wherein the bottom portion is formed as a curved portion gently sloping forward and backward, wherein two or more slots substantially parallel to a direction in which these portions continue are formed in a boundary portion between the bottom portion and the backrest portion, wherein a portion sandwiched between the slots or a portion near the slots is formed so as to have greater curvature than other portions, wherein sideway notches connected to the slots positioned on the right-hand and left-hand sides are formed extending toward the right-hand and left-hand edges of the bottom portion, and wherein groove-like bent portions intersecting with the notches are formed on the right-hand and left-hand edges of the bottom portion.

To achieve the second object, this invention also provides a shell structure for a backrest of a chair wherein a lower portion of a main structure of the shell structure is attached and joined to upper portions of back supporting bars, which main structure is formed so that the shape of the main structure as seen from the front can conform to the shape of the backrest as seen from the front, and which main structure has a jagged crosssectional shape where substantially parallel projections and recesses forming grooves extend in a longitudinal direction of the backrest.

DESCRIPTION OF THE PREFERRED EMBODIMENTS

Figure 1:
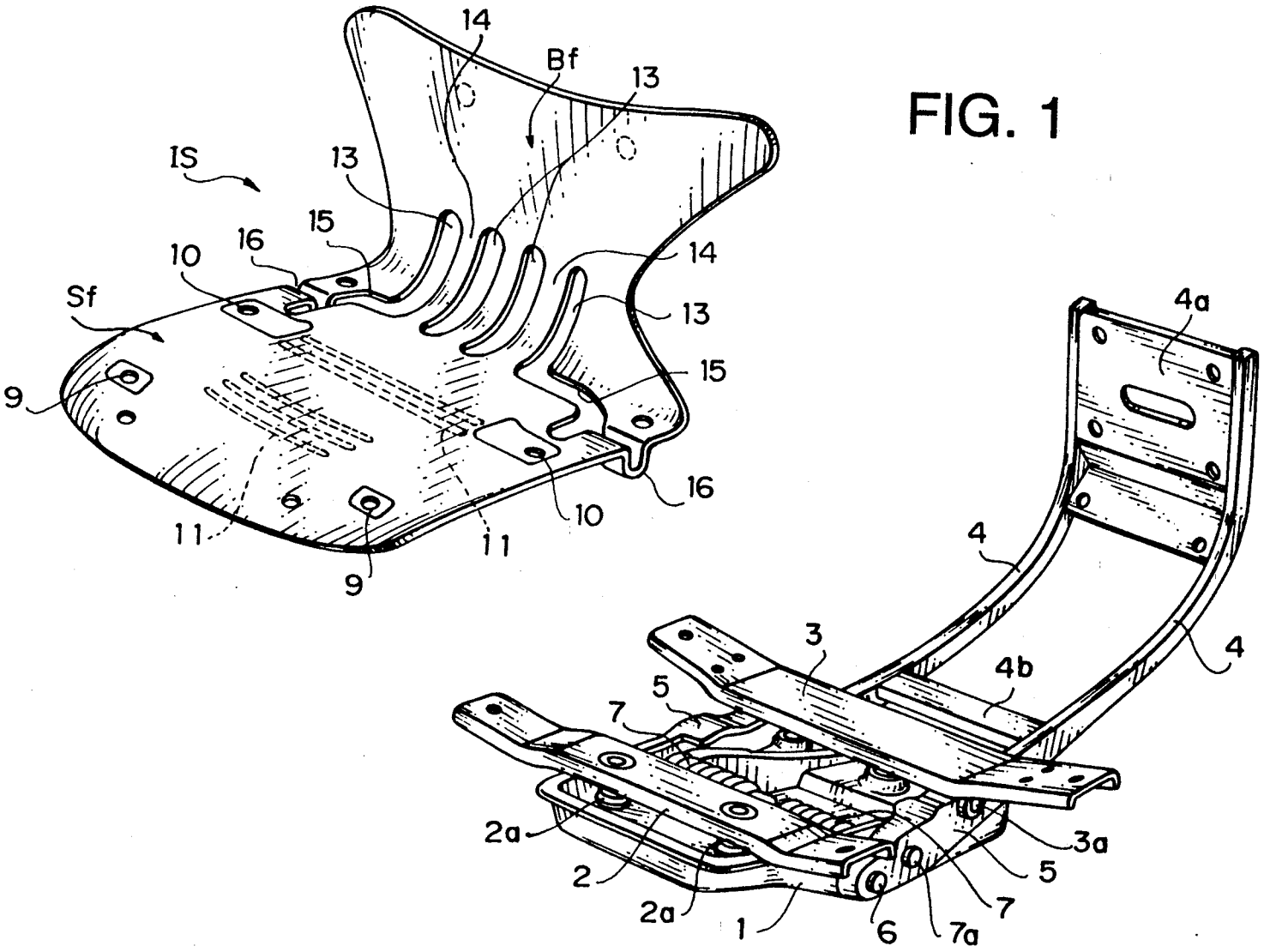
FIG. 1 shows a perspective view of a shell structure in accordance with the present invention and another perspective view of a frame construction of a chair to which the shell structure is attached.
Figure 2:
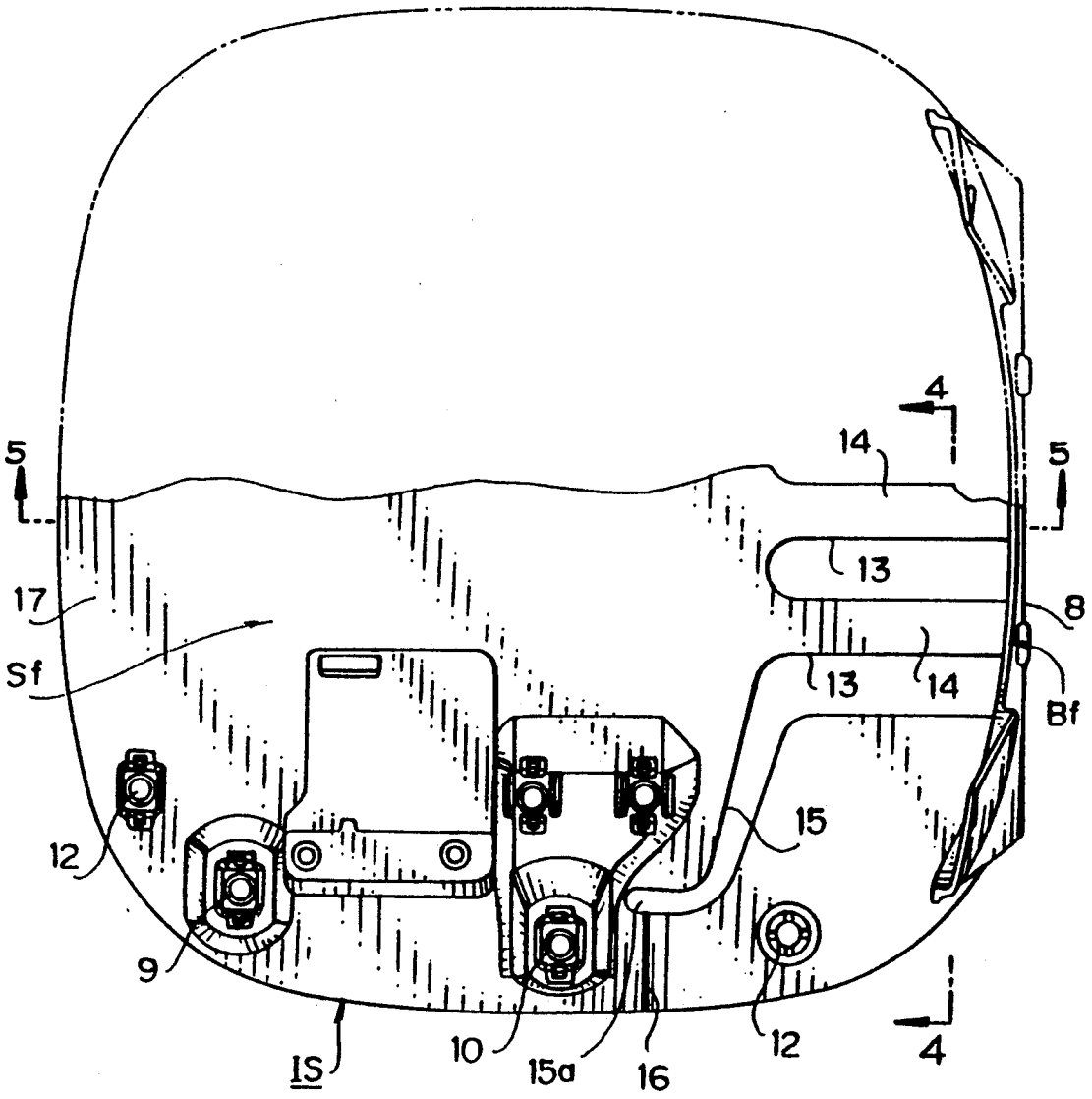
FIG. 2 is a plan view of the right half of the shell structure shown in FIG. 1.
Figure 3:
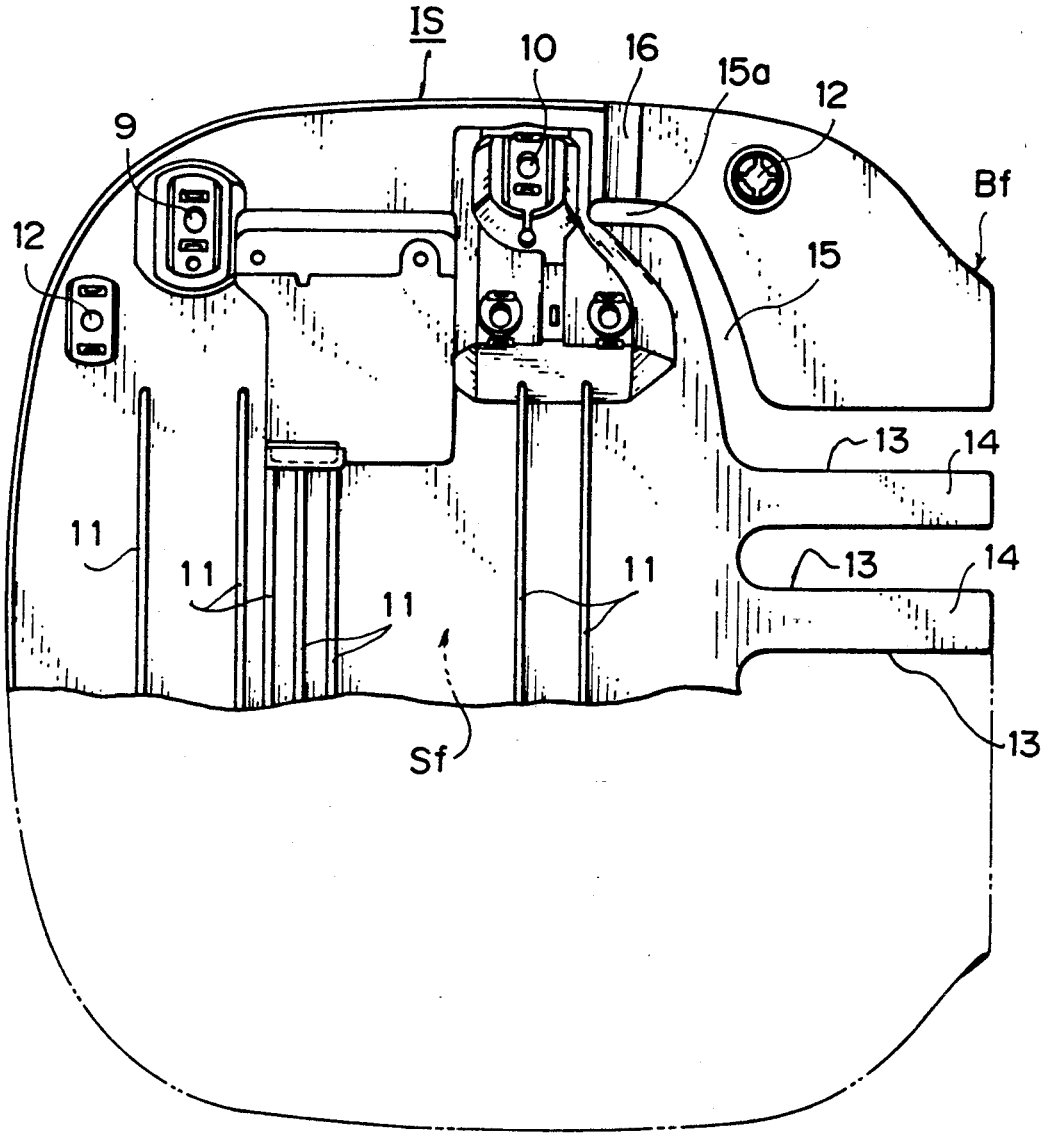
FIG. 3 is a bottom plan view of the shell structure shown in FIG. 2.

An embodiment of a shell structure according to the present invention will be described below with reference to FIGS. 1 to 8.

In FIGS. 1 to 8, numeral 1 denotes a box-like attaching base secured to the upper end of a supporting member P having legs at the lower end of the supporting member P. A frame is disposed in the attaching base 1. Numerals 2 and 3 denote front and back frame members for attaching a bottom portion Sf of a shell structure IS according to the present invention. The front frame member 2 is attached with the aid of two springs 2*a* to the front portion of the attaching base 1.

The back frame member 3 is pivotally attached to the obverse surfaces of two lever members 5 connected to the lower ends of two back supporting bars 4. This attachment is made with the aid of horizontal shafts 3*a*. The front portions of the lever members 5 are affixed by a shaft 6 to the attaching base 1 so that the lever members 5 can freely rock. Reference character 4*a* denotes a connecting member disposed between the back portions of the back supporting bars 4, and likewise, reference character 4*b* denotes another connecting member disposed between the front portions of the back supporting bars 4.

Two torsion coil springs 7 are disposed around an attaching shaft 7*a* between the lever members 5 and the attaching base 1 so that the repelling force acting on the springs 7 serves as a force which rotates counterclockwise the lever members 5 and the back supporting bars 4, integral with the lever members 5. Reference character 7*b* denotes one end of each coil spring 7, and it is connected to a spring adjusting portion 7*d*. The other end 7*c* of each coil spring 7 is held by a spring-receiving portion 5*a* formed on the obverse surface of each lever member 5, thereby receiving the repelling force mentioned above.

In a construction described above, the back frame member 3, for attaching the shell structure IS of this invention, and the back supporting bars 4 are rocked on the shaft 6 which affixes the lever members 5 to the attaching base 1, but the front frame member 2 is not rocked as the back frame 3 and the back supporting bars 4 are rocked.

The back frame member 3 and the back supporting bars 4, both types of members being capable of rocking, do not move in the same manner because each back supporting bar 4 has a substantially L-shaped configuration as seen from the side thereof.

The shell structure IS of the present invention is attached to the front and back frame members 2 and 3 and the back supporting bars 4. Three types of components 2, 3 and 4 can move in three different ranges. The shell structure IS can move as the three types of components 2, 3 and 4 move. This is a feature of this invention which will be described below.

The shell structure IS, shown in FIGS. 2 to 6, is composed of the bottom portion Sf and a portion Bf for connecting the bottom portion Sf to a shell structure for the backrest (hereinafter referred to as a continuous portion Bf). The continuous portion Bf is raised from a curved connecting portion 8 which continues to the back portion of the bottom portion Sf. This bottom portion Sf has a configuration similar to that of the bottom of the seat. It is usually formed by monolithic molding using synthetic resin. A material for the shell structure IS and a molding method therefor may be appropriately selected from various materials and methods.

Numeral 9 denotes a pair of front fixing seats formed in the reverse surface of the bottom portion Sf. Similarly, numeral 10 denotes another pair of back fixing seats formed in the reverse surface of the bottom portion Sf. The shell structure IS is affixed to the front frame member 2 as, for example, by screwing the front fixing seats 9 close to the right-hand and left-hand ends of the front frame member 2, and also by screwing the back fixing seats 10 close to the right-hand and left-hand ends of the front frame member 3. A portion between the front and back fixing seats 9 and 10 of the bottom portion Sf is formed as a curved portion Sc which curves gently forward and backward.

Numeral 11 denotes a plurality of ribs formed extending toward the right-hand and left-hand sides of the reverse surface of the bottom portion Sf. Numeral 12 denotes part attaching portions formed at appropriate intervals along the periphery of the shell structure IS. The attaching portions 12 are formed as bolt holes together with pedestals, and are used for attaching an outer shell, a facing material or a cushioning medium to the shell structure IS.

Numeral 13 denotes oblong slots which are formed extending from the back portion of the bottom portion Sf to the connecting portion 8 of the continuous portion Bf. In this embodiment, there are four such oblong slots symmetrically formed with respect to a line running at the center of the bottom portion Sf.

Figure 4:
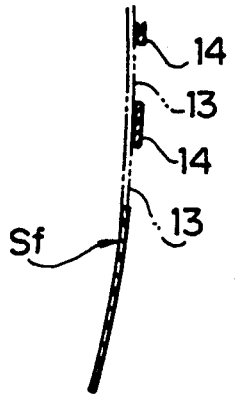
FIG. 4 is an end view taken along line A—A of FIG. 2.
Figure 5:
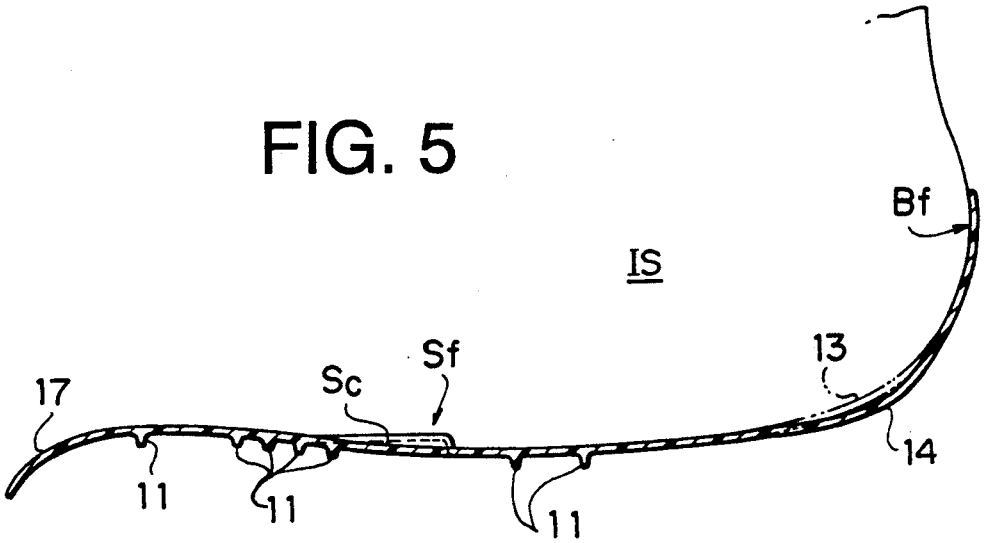
FIG. 5 is an end view taken along line B—B of FIG. 2.
Figure 6:
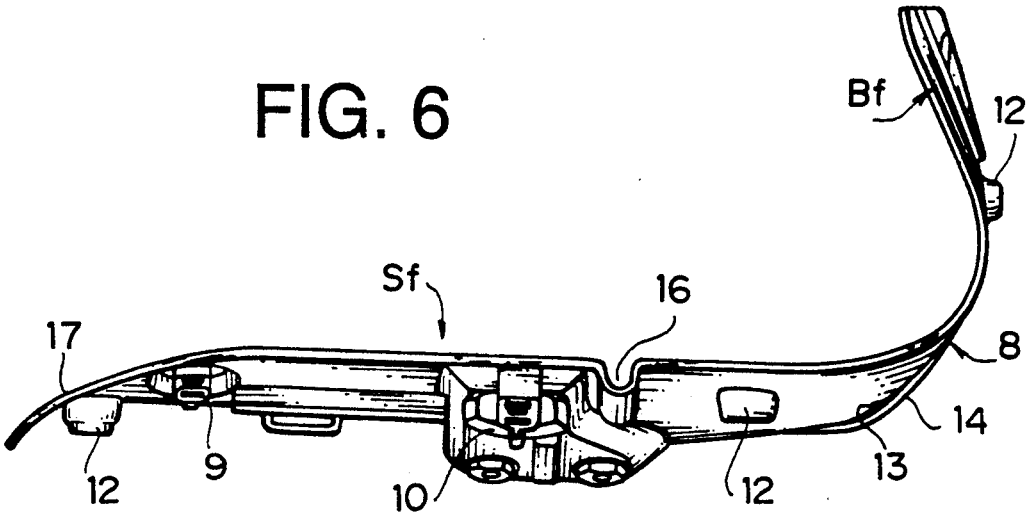
FIG. 6 is a side view of the shell structure.

As shown in FIG. 4, strips 14 sandwiched between the four slots 13 are formed in such a manner that they expand outwardly from the slots 13 formed in the connecting portion 8.

Numeral 15 denotes continuous slots 15. One continuous slot 15 is connected to one end of the extreme right slot 13, and extends outwardly from this end. Similarly, the other continuous slot 15 is connected to one end of the extreme left slot 13, and extends outwardly from this end. Ends 15*a* of the continuous slots 15 are formed so that the ends 15*a* become substantially parallel to the slots 13. In this embodiment, the end 15*a* of each continuous slot 15 is formed in a portion close to each back fixing seat 10.

Numeral 16 denotes substantially U-shaped bent portions formed on the right-hand and left-hand edges of the bottom portion Sf. One end 15*a* of each continuous slot 15 is connected to each bent portion 16.

Numeral 17 denotes a flexible edge formed at the front portion of the bottom portion Sf, which includes the right-hand and left-hand front fixing seats 9. It is formed by reducing the thickness of this front portion a little more than the thickness of other portions of the bottom portion Sf.

The continuous portion Bf is continuous with the connecting portion 8, which in turn is continuous with the bottom portion Sf, and is inclined forward a little. The degree of such an inclination can be arbitrarily set beforehand so as to conform to the inclination of the back supporting bars 4.

In this embodiment, the height of the continuous portion Bf substantially corresponds to the height of the lower half of the shell structure for the backrest described later. However, the height of the continuous portion Bf may be set beforehand so as to substantially correspond to the overall height of the backrest.

As shown in FIG. 1, when the thus-constructed shell structure IS is used as an inner shell, it, together with an outer shell (not shown), is attached to the frame. This attachment is made in the following way. The front and back fixing seats 9 and 10, formed on the shell structure IS, are secured by screws to the front and back frame members 2 and 3, respectively. An attaching portion of the continuous portion Bf is also secured to the connecting member 4*a*, disposed between the back portions of the back supporting bars 4.

Figure 7:
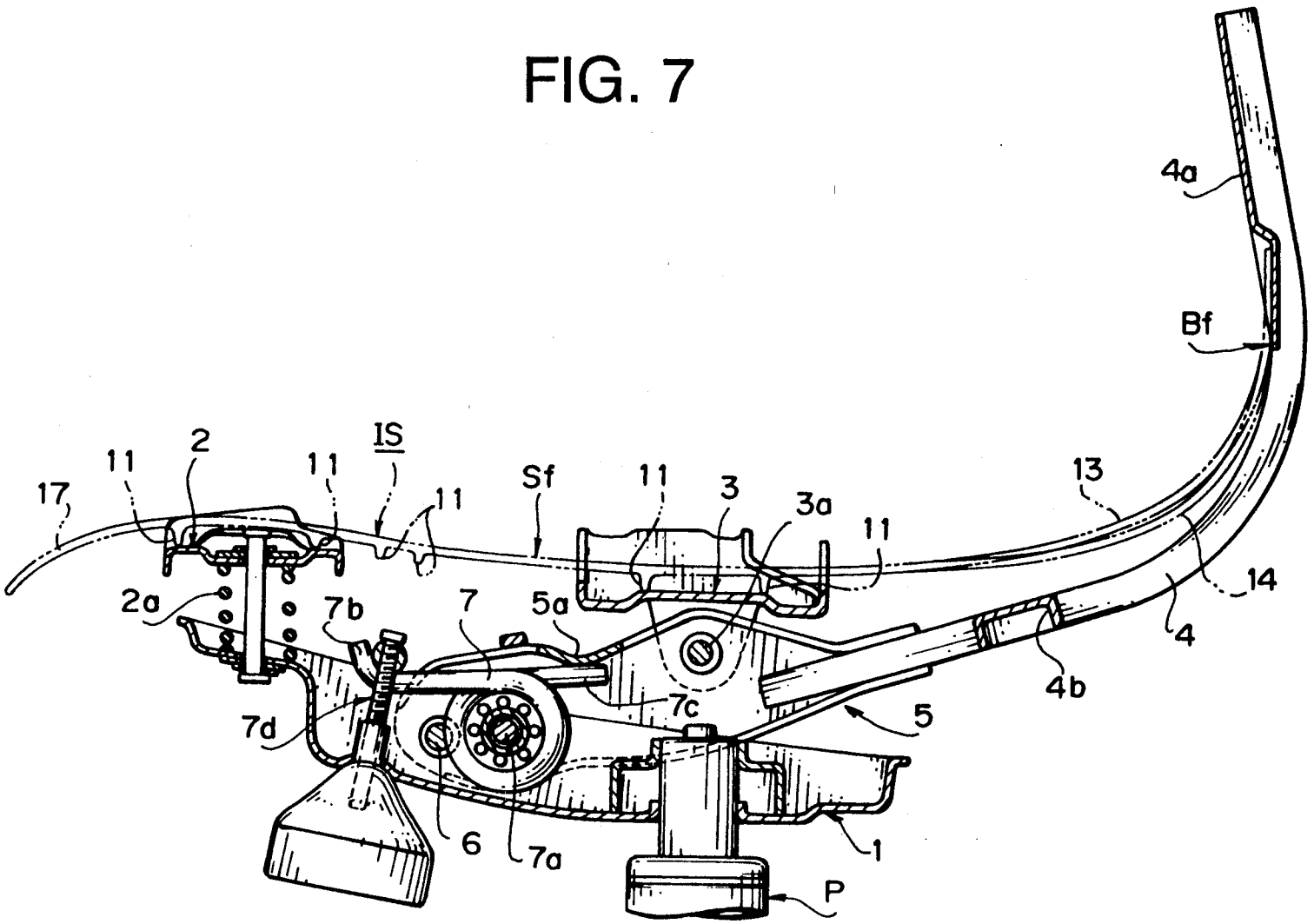
FIG. 7 is a sectional side elevation of the shell structure when various components shown in FIG. 1 are assembled.

When the thus-attached shell structure IS is used as an inner shell, as shown in FIG. 7, a seat material (not shown), made of a cushioning material, and a backrest material B, also made of the cushioning material, are attached to the surface of the bottom portion Sf and the front surface of the continuous portion Bf, respectively. Various types of aesthetically appealing outer shells (not shown) may also be attached as required.

Figure 8:
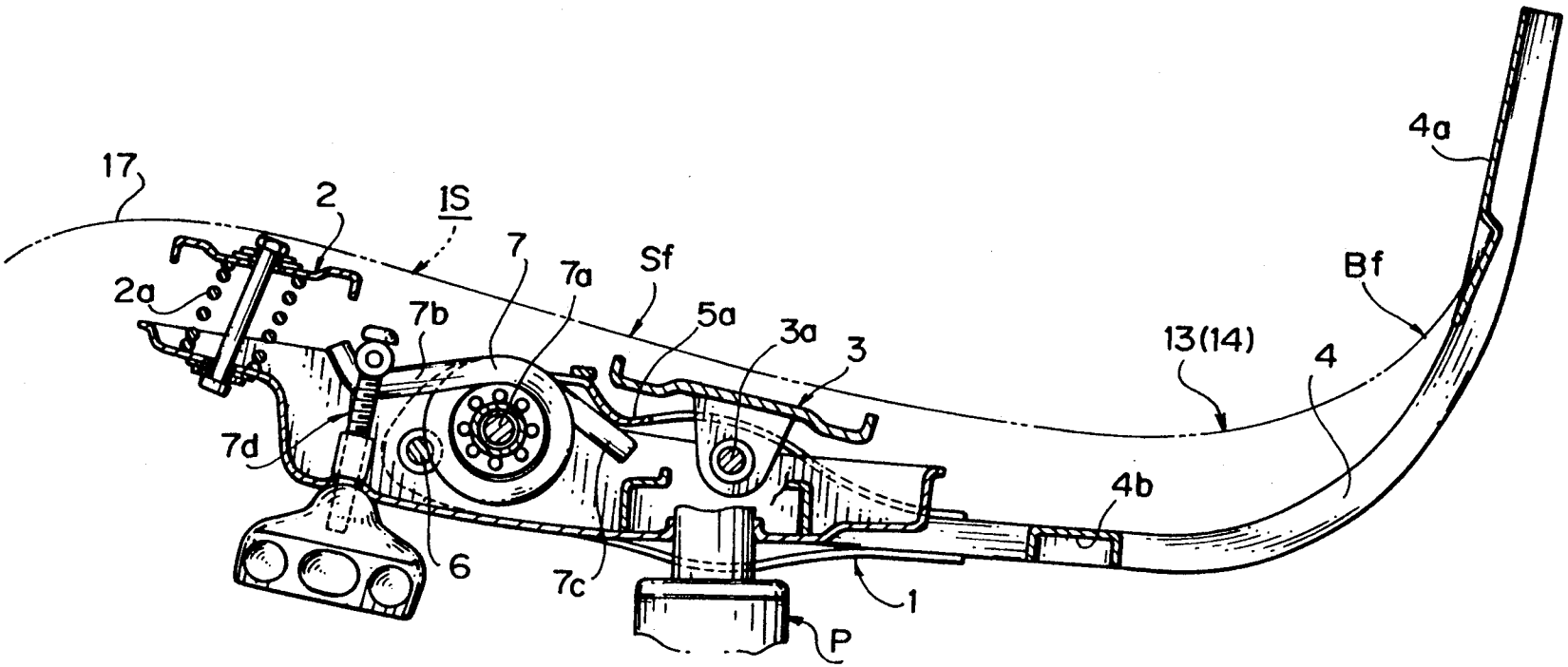
FIG. 8 is a sectional side elevation of the shell structure when load is applied and the shell structure is inclined backward.

When a person sits down in the chair shown in FIG. 7 and leans back against the backrest B, the leaning load causes the back supporting bars 4 to incline backward on the shaft 6 (see FIG. 8).

Such a backward inclination in turn causes the seat to sink on the shaft 6 of the lever members 5, and at the same time the back portion of the bottom portion Sf also sinks because the back frame member 3, supporting the shell structure IS, is mounted on and supported by the obverse surfaces of the lever members 5 so that the back frame member 3 can rock pivotally on the horizontal shafts 3*a*.

Since the distance between the shaft 6 and the back supporting bars 4 differs from that between the shaft 6 and the lever members 5, the degree to which the back supporting bars 4 incline backward differs greatly from the degree to which the lever members 5 sink. As a result, components secured to the frame of the shell structure IS and those disposed between the frame and the seat are forced to move differently as the seat sinks.

In accordance with the present invention, a flexible portion of the shell structure IS is capable of absorbing various kinds of movements made by the various components of the shell structure IS for the following reasons: (1) the middle portion of the bottom portion Sf, attached to the front and back frame members 2 and 3, is formed as a gently curved portion; (2) the connecting portion 8, where the bottom portion Sf is joined to the continuous portion Bf, is formed of the slots 13 and the strips 14 expanding outwardly from the slots 13; and (3) the U-shaped bent portions 16, connected to the slots 13, are formed on the right-hand and left-hand edges of the bottom portion Sf.

The flexible edge 17 of the bottom portion Sf is formed so that it moves more flexibly than the other portions of the bottom portion Sf when load is applied as, for example, by forward inclination of a seated person. A seated person does not feel pressure on his thighs because of such flexibility and the fact that the front frame member 2, supporting the flexible edge 17, moves independently of the other components.

The middle portion of the bottom portion Sf is constructed in such a way that the rigidity thereof is improved by forming ribs so that the middle portion is unlikely to deform even when it primarily receives the sitting load. Therefore despite the flexible portion 17, feeling of comfort can be obtained.

In the shell structure of this invention, the lower half of a backrest forming portion is integrally formed with the bottom portion, whereas the upper half of the backrest forming portion is formed separately from the lower half. For this reason, a small mold can be used to form such a shell structure. Because the upper half of the backrest can have any configuration which may differ in design from the lower half, the shell structure is widely used as a common shell structure for use with various types of chairs having backrests of different heights.

As has been described above, even when the seat and seat back are integrally formed together in a shell structure of the present invention, the shell structure is constructed so as to smoothly move in a manner different from the manner in which the seat and the backrest move, and therefore can be used effectively as a shell structure for a type of chair integral with the seat and seat back.

An embodiment of the shell structure for a backrest (hereinafter called simply the shell structure) according to this invention will now be described with reference to FIGS. 9 to 21. In these drawings, numeral 20 designates the main structure of the shell structure. The main structure 20 has the shape of an ellipse or trapezoid with its rounded corners, as seen from the front. The main structure 20 is formed of synthetic resin, such as nylon or polypropylene, or of appropriate sheet metal.

Numeral 21 designates a flat peripheral portion, having an appropriate width, which is formed along the outer periphery of the main structure 20. Numerals 22 and 23 designate recesses extending substantially along the length of the main structure 20, but not on the peripheral portion 21. Each of the recesses 22 and 23 has the crosssectional shape of a groove. A projection 24 is formed at the right-hand side of the recess 22; another projection 25 is formed between the recesses 22 and 23; and a further projection 26 is formed at the left-hand side of the recess 23. The recesses 22 and 23 and the projections 24, 25 and 26 are shown only in the left half of the main structure 20 of FIG. 9.

Figure 9:
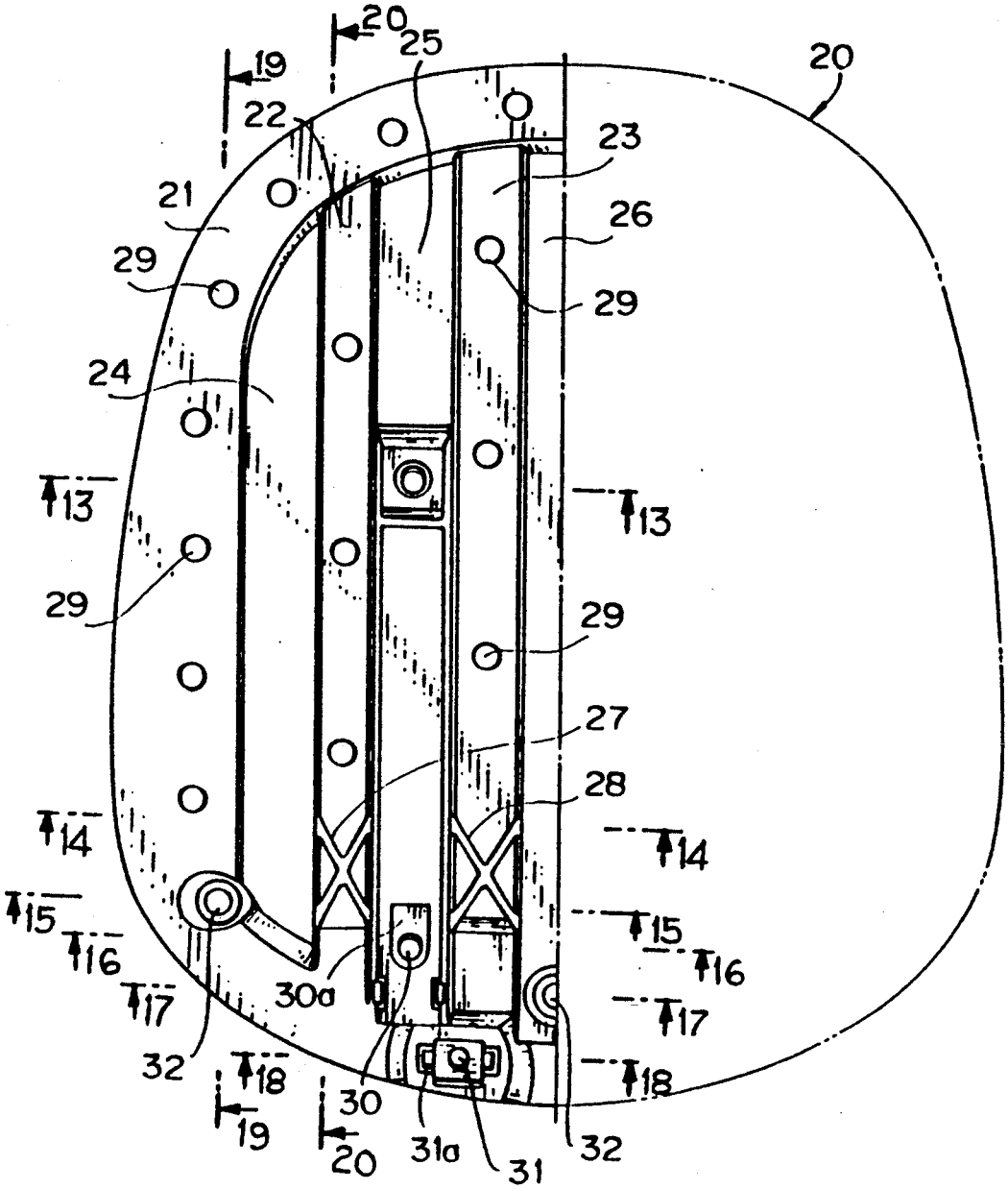
FIG. 9 is a front view showing an embodiment of a shell structure for a backrest according to this invention, in which view components of the right half of the backrest shell structure are not shown.
Figure 10:
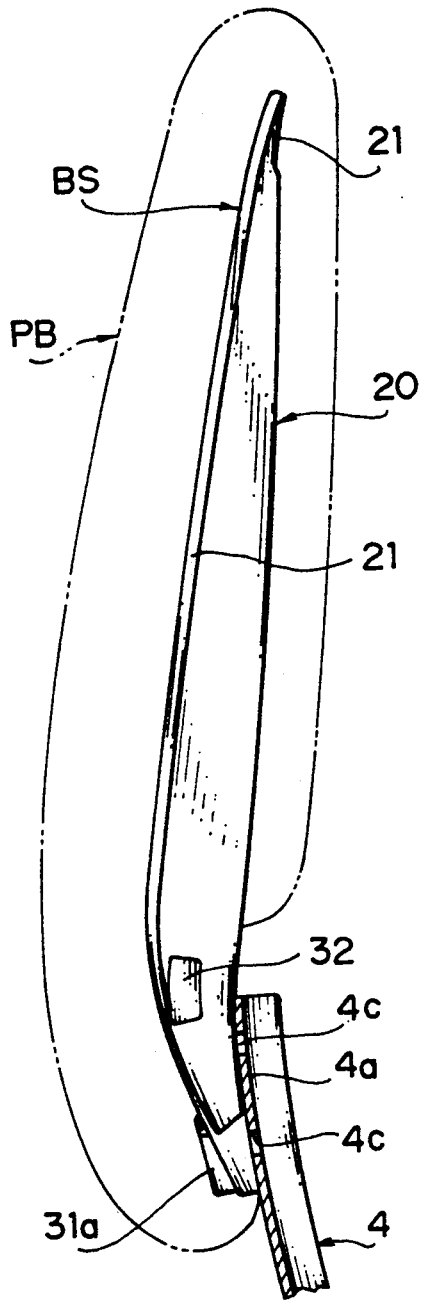
FIG. 10 is a right side view of the backrest shell structure shown in FIG. 9.
Figure 11:
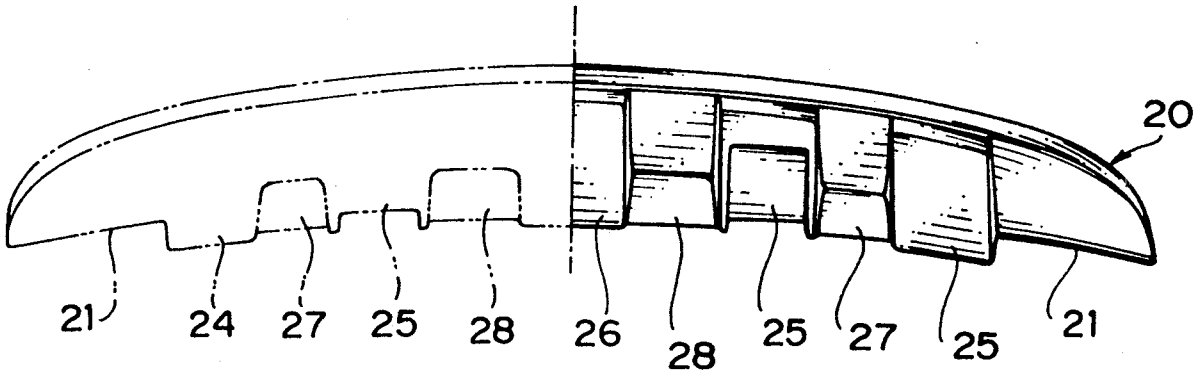
FIG. 11 is a plan view clearly showing only the right half of the shell structure.
Figure 12:
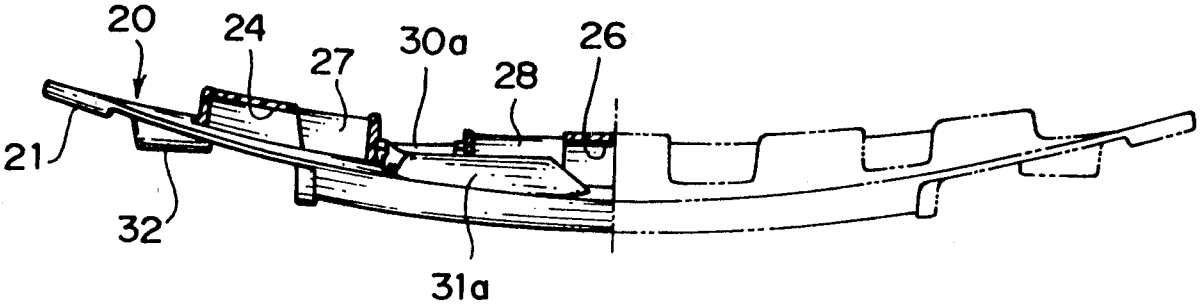
FIG. 12 is a bottom view clearly showing only the left half of the shell structure.

The recesses 22 and 23 and the projections 24, 25 and 26 are alternately formed so as to have a jagged crossectional shape As shown in FIG. 9, these recesses and projections are formed symmetrically and parallel to a longitudinal direction of the main structure 20.

In this invention, the recesses 22 and 23 and the projections 24, 25 and 26 may also be formed so as to have the crosssectional shape of, for instance, "V" or "U".

Although these recesses and projections are formed parallel to each other, they may be formed to fan out as they approach the upper portion of the main structure 20.

The recesses 22 and 23 are formed so that the depth of each recess is greater on the upper portion of the main structure 20 than on the lower portion thereof. Likewise, the projections 24, 25 and 26 are formed so that the height of each projection, as seen in cross section, is greater on the upper portion of the main structure 20 than on the lower portion. This is to cause the upper portion of the main structure to bend more than the lower portion thereof. To vary the amount of bending, the widths of the recesses 22 and 23 and of the projections 24, 25 and 26 may be increased or decreased gradually in the upper or lower portion of the main structure 20. Similarly, the thickness of the upper or lower portion of the main structure 20 may also be increased or decreased gradually in the upper or lower portion of the main structure 20. In addition, the recesses and the projections may be formed so that the depths of the recesses differ from the heights of the projections as seen in cross section.

Figure 13:
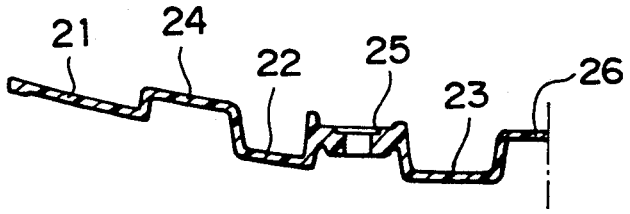
FIG. 13 is an end view taken along line A—A of FIG. 9.
Figure 14:
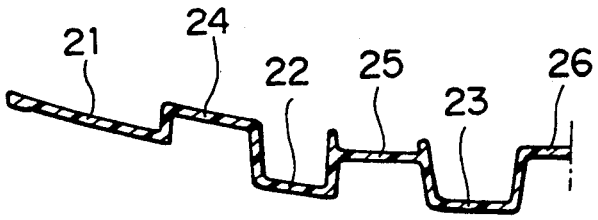
FIG. 14 an end view taken along line B—B of FIG. 9.
Figure 15:
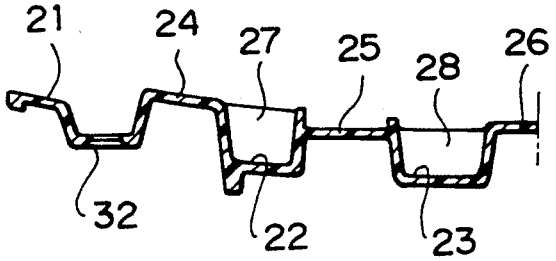
FIG. 15 an end view taken along line C—C of FIG. 9.
Figure 16:
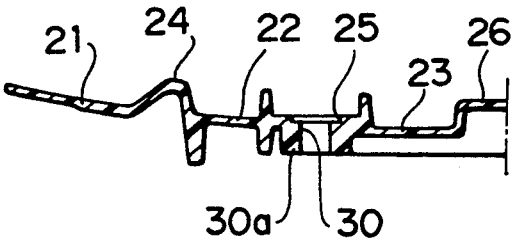
FIG. 16 is an end view taken along line D—D of FIG. 9.
Figure 17:
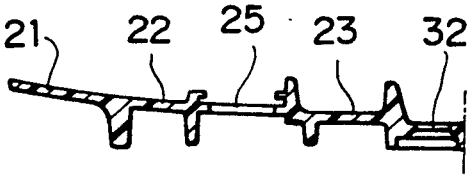
FIG. 17 is an end view taken along line E—E of FIG. 9.
Figure 18:
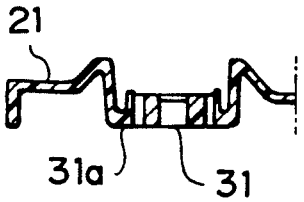
FIG. 18 is an end view taken along line F—F of FIG. 9.
Figure 19:
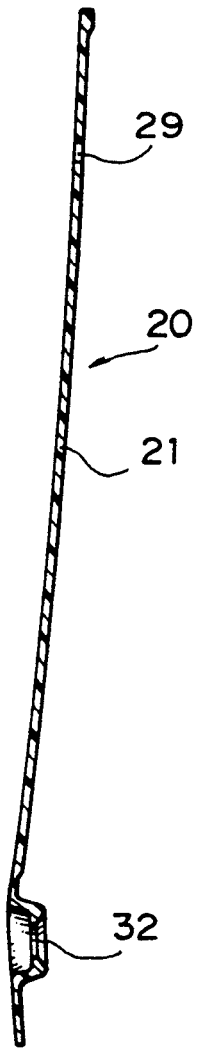
FIG. 19 is an end view taken along line G—G of FIG. 9.
Figure 20:
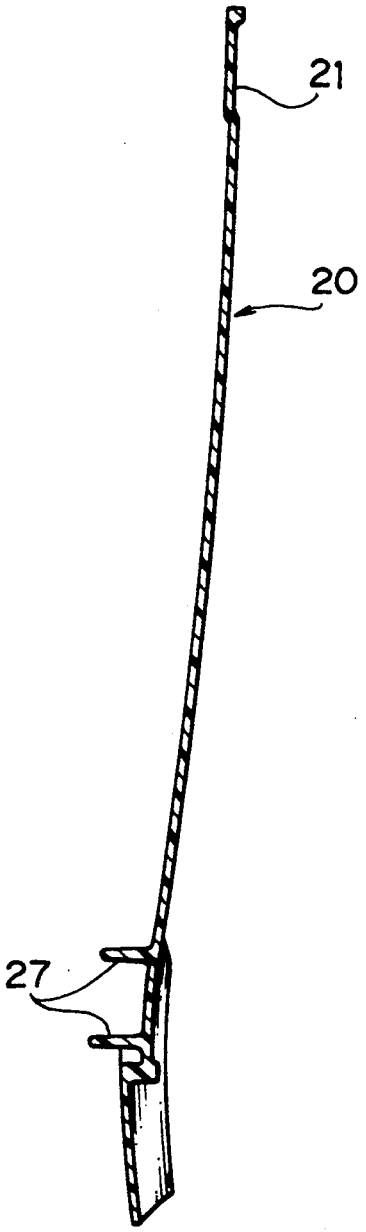
FIG. 20 is an end view taken along line H—H of FIG. 9.

Numerals 27 and 28 designate ribs formed in the lower portions or ends of the recesses 22 and 23. The rib in each recess is formed in the shape of "X". These ribs 27 and 28 are formed so as not to bend that portion of the main structure 20 where the ribs 27 and 28 are formed. The main structure 20 thus becomes substantially rigid. Because of the function of the ribs 27 and 28, the back supporting bars 4 shown in FIG. 13 are integrally and firmly formed with the main structure 20. Though not shown in FIG. 9, these ribs are also formed in recesses in the right half of the main structure 20 symmetrical to the ribs 27 and 28.

In this embodiment, the ribs 27 and 28 are formed only in the recesses 22 and 23. However, other ribs may also be formed on the projections 24, 25 and 26 of the reverse surface of the main structure, i.e., in grooves formed on the projections 24, 25 and 26. These additional ribs may be formed together with or without the ribs 27 and 28.

Numeral 29 designates through-holes scattered over the entire surface of the main structure 20. When a foamed elastic material is formed on the front and back surfaces of the shell structure by, for example, an insert molding method, the foamed elastic materials are connected to each other via the many through-holes 29. The foamed elastic material improves covering and adhesion properties of the main structure 20.

Numerals 30 and 31 designate holes for attaching the shell structure of this invention to the back supporting bars 4. In this embodiment, four such holes are bored symmetrically in positions below the ribs 27 and 28. Reference characters 30*a* and 31*a* designate bearing surfaces for setting the holes 30 and 31 on the same surface.

As shown in FIG. 9, numeral 32 designates a snap-opening for attaching the outer shell. The snap-opening 32 is formed at the center of the lower portion of the main structure 20. The shape of the snap-opening 32 and the position where it is bored depend on the outer shell.

The thus-constructed shell structure of this invention may be attached to the backrest in the following manner. When an insert molding method, for example, is used to laminate a foamed elastic material PB, such as urethane resin, onto the front and back surfaces of the main structure 20 so that the foamed elastic material PB and the main structure 20 form an integral structure. In this embodiment, the foamed elastic material PB should not be laminated on the reverse surface of the main structure 20 where the holes 30 and 31 are formed because these holes are used for attaching the back supporting bars 4 (see FIG. 10).

An appropriate covering of cloth or leather is applied to the front surface of the main structure 20. The main structure 20 is attached as, for example, by bolts to the back supporting bars 4. The outer shell (not shown) is also attached with the aid of the snap-opening 32 to the back supporting bars 4. The thus-constructed backrest integral with the shell structure of this invention is used as the backrest of a seat.

Figure 21:
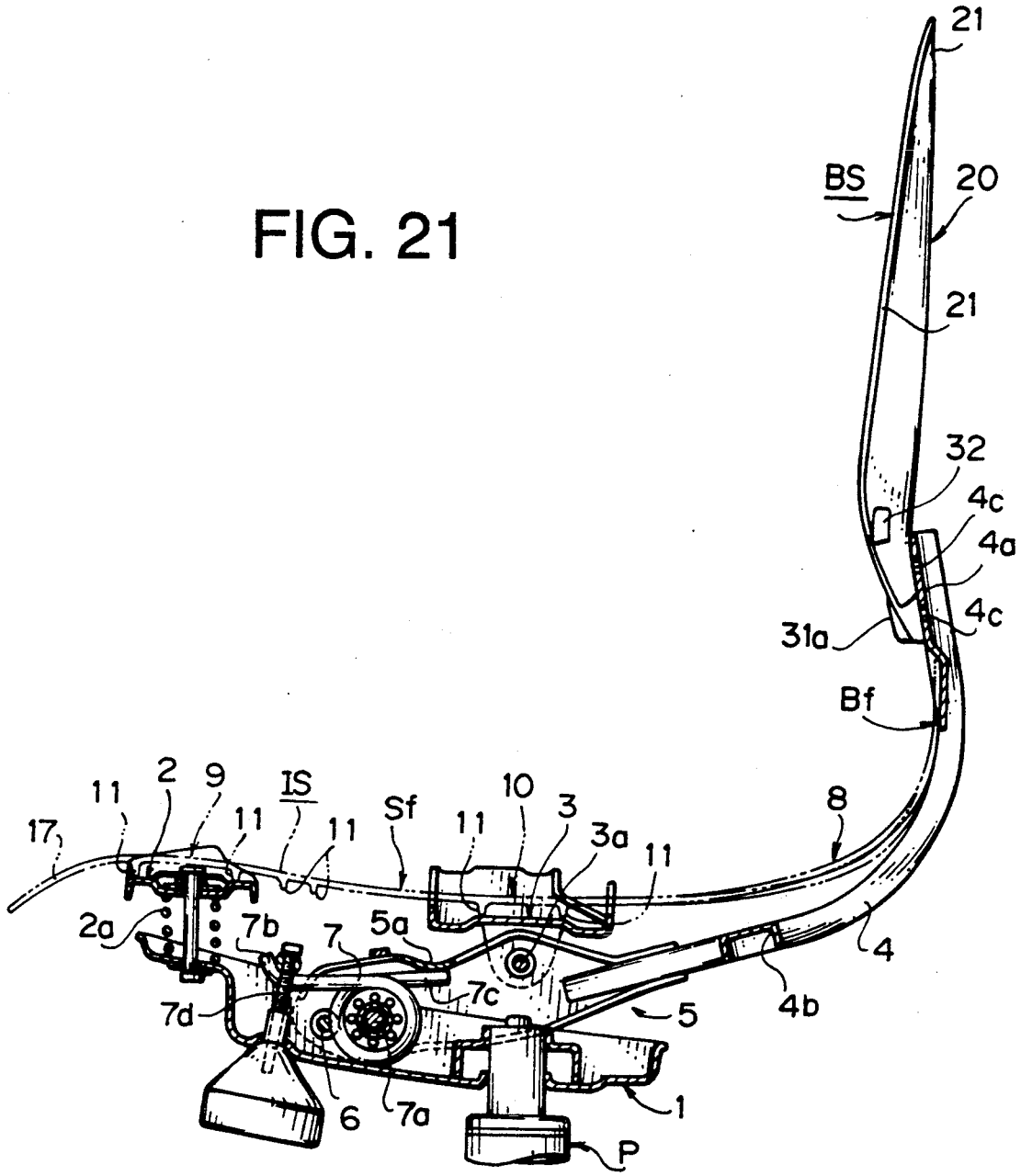
FIG. 21 is a side view showing how the shell structure for the backrest of this invention is attached to the frame construction of a chair.

FIG. 21 is a side view illustrating how the backrest is attached to the frame construction of the chair. In this drawing, numeral 1 denotes the box-like attaching base secured to the upper end of the supporting member P having legs at the lower end of the supporting member P. The frame is disposed in the attaching base 1. Numerals 2 and 3 denote the front and back frame members for attaching the bottom portion Sf of the shell structure IS, according to this invention, shown in FIGS. 1 to 8. The front frame member 2 is attached with the aid of the two springs 2*a* to the front portion of the attaching base 1.

The back frame member 3 is pivotally attached to the obverse surfaces of the two lever members 5 connected to the lower ends of the two back supporting bars 4. This attachment is made with the aid of the horizontal shafts 3*a*. The front portions of the lever members 5 are affixed by the shaft 6 to the attaching base 1 so that the lever members 5 can freely rock. Reference character 4*a* denotes the connecting member disposed between the back portions of the back supporting bars 4, and likewise, reference character 4*b* denotes the connecting member disposed between the front portions of the back supporting bars 4.

The two torsion coil springs 7 are disposed around the attaching shaft 7*a* between the lever members 5 and the attaching base 1 so that the repelling force acting on the springs 7 serves as a force which rotates counterclockwise the lever members 5 and the back supporting bars 4, integral with the lever members 5. Reference character 7*b* denotes one end of each coil spring 7, and it is connected to the spring adjusting portion 7*d*. The other end 7*c* of each coil spring 7 is held by the spring-receiving portion 5*a* formed on the obverse surface of each lever member 5, thereby receiving the repelling force mentioned above.

In a construction described above, the back frame member 3, for attaching the shell structure IS of this invention, and the back supporting bars 4 are rocked on the shaft 6 which affixes the lever members 5 to the attaching base 1, but the front frame member 2 is not rocked as the back frame 3 and the back supporting bars 4 are rocked. The front frame member 3 and the back supporting bars 4, both types of members being capable of rocking, do not move in the same manner because each back supporting bar 4 has a substantially L-shaped configuration as seen from the side thereof.

The shell structure IS is attached to the front and back frame members 2 and 3 and the back supporting bars 4. Three types of components 2, 3 and 4 can move in three different ranges. The shell structure IS can move as the three types of components 2, 3 and 4 move.

The shell structure IS shown in FIG. 21 is composed of the bottom portion Sf and the continuous portion Bf. The continuous portion Bf is raised from the curved connecting portion 8 which continues to the back portion of the bottom portion Sf. This bottom portion Sf has a configuration similar to that of the bottom of the seat. The shell structure described above is attached to the continuous portion Bf.

Numeral 9 denotes a pair of front fixing seats formed in the reverse surface of the bottom portion Sf. Similarly, numeral 10 denotes another pair of back fixing seats formed in the reverse surface of the bottom portion Sf. The shell structure IS is affixed to the front frame member 2 as, for example, by screwing the front fixing seats 9 close to the right-hand and left-hand ends of the front frame member 2, and also by screwing the back fixing seats 10 close to the right-hand and left-hand ends of the front frame member 3. Numeral 11 denotes a plurality of ribs formed extending toward the right-hand and left-hand sides of the reverse surface of the bottom portion Sf.

The continuous portion Bf of the shell structure IS mentioned above is formed so that it is raised a little from the connecting portion 8 of the bottom portion Sf and is tilted forward a little. In this embodiment, the continuous portion Bf is short because it is formed so as to appear to be continuous with the lower portion of the backrest formed of the shell structure BS of this invention.

Four attaching holes 4*c* formed in the connecting member 4*a* of the back supporting bars 4 are mated with the holes 30 and 31 bored in the lower portion of the main structure 20. The shell structure BS is secured by bolts (not shown) to the back supporting bars 4. FIG. 21 shows the shell structure BS on which the foamed elastic material PB is not laminated.

As shown in FIGS. 9 to 21, because of the recesses and projections, the shell structure BS for the backrest is formed so as to have a jagged crosssectional shape. The ribs formed in the recesses improve the rigidity of the lower portion of the shell structure BS. The back supporting bars 4 are integrally connected to that portion of the shell structure BS having improved rigidity. The front and back surfaces of the main structure of the shell structure BS are covered with the foamed elastic material. Because of the above features, the shell structure BS of this invention has the following advantages.

Because of the jagged crosssectional shape of the shell structure BS for the backrest, the entire backrest having such a shell structure bends smoothly while that portion to which the shell structure is connected to the back supporting bars maintains a high rigidity. The backrest bends smoothly, even, for example, a seated person changes the position of his back. Furthermore, since the foamed elastic material is laminated on the front and back surfaces of the shell structure BS and since the grooves forming the jagged shape are filled with the foamed elastic material, the backrest resists bending too much, and thus bends only moderately.

If a heavy load is applied to the backrest, the load is supported by the portion of the shell structure BS that has rigidity and is integral with the back supporting bars when the upper portion of the shell structure BS bends. The load is transmitted to the back supporting bars and the lever members which are integral with the supporting bars. In this way, the entire backrest including the back supporting bars is inclined.

In other words, a light load is supported by moderate bending of the main structure of the shell structure. On the other hand, a heavy load is supported by bending of the main structure as well as inclination of the back supporting bars attached to the main structure. Thus the shell structure BS inclines stably regardless of the magnitude of the load applied to the backrest, and thus can be used effectively as an inner shell for the backrest.

The shell structure for the backrest is used as an inner shell for the backrest of a chair having the back supporting bars shown in FIG. 13. However, it may also be used as an inner shell for the backrest of a chair having other attaching and supporting structures. The same advantages as those described in the above embodiment can be obtained with the latter backrest.

Even when the seat and seat back are integrally formed together in a shell structure of the present invention, the shell structure is constructed so as to smoothly move in a manner different from the manner in which the seat and the backrest move, and therefore can be used effectively as a shell structure for a type of chair integral with the seat and seat back.

A light load is supported by the moderate bending of the main structure. On the other hand, a heavy load is supported by bending of the main structure as well as inclination of the back supporting bars attached to the main structure. The shell structure for the backrest according to this invention inclines stably regardless of the magnitude of the load applied to the backrest, and thus can be used effectively as an inner shell for the backrest.

What is claimed is:

1. A shell structure for use with a chair having a synchronously moving seat and seat back, the shell structure for the seat comprising:

a bottom portion and a back portion of the same material, with a curved connecting therebetween;

said curved connecting portion having at least two slots extending between said bottom portion and said back portion, wherein a portion of said curved connecting portion sandwiched between said slots has a greater curvature than other portions of said curved connecting portion;

sideways notches extending outwardly from the outermost ones of said slots adjacent said bottom portion; and U-shaped bent portions extending out of the plane of said curved connecting portion and outwardly from said notches.

2. A shell structure according to claim 1 wherein the rigidity of the center of said bottom portion is more than that of other portions of said bottom portion.

3. A shell structure for a backrest according to claim 1, wherein said shell structure comprises at least one of the materials selected from the group consisting of nylon, polypropylene, synthetic resin, and a light metal.

4. A shell structure according to claim 1, wherein the elasticity of a front edge of said bottom portion is more than that of other portions of said bottom portion.

5. A shell structure according to claim 4 wherein the rigidity of the center of said bottom portion is more than that of other portions of said bottom portion.

6. A shell structure for a chair having a seat and a seat back comprising:

a seat shell having a bottom portion and a back portion connected by a curved portion;

said curved portion having plural slots therein extending between said bottom portion and said back portion;

a notched portion extending generally perpendicularly from each of the outermost ones of said plural slots;

a U-shaped bent portion extending outwardly from each said notched portion and out of the plane of said curved portion for increasing the flexibility of said curved portion while maintaining the strength of said curved portion; and a seat back shell having generally parallel grooves therein, said grooves extending generally vertically when said seat back shell is attached to the chair, said grooves being shallower in a lower portion of said seat back shell than in an upper portion thereof.

7. The shell structure of claim 6 wherein said seat back shell has an outer periphery that is generally flat.

8. The shell structure of claim 6 wherein said curved portion comprises portions between said slots that have a greater curvature than other portions thereof.

* * * * *